United States Patent [19]

Brown et al.

[11] Patent Number: 4,494,698

[45] Date of Patent: Jan. 22, 1985

[54] POLYURETHANE SPRAY NOZZLE FOR ABRASIVE SLURRIES

[75] Inventors: Richard A. Brown, Hixson; John D. Trew, Nashville, both of Tenn.

[73] Assignees: Porter-Walker, Inc., Columbia; Urethane Specialties, Inc., Davidson County, both of Tenn. ; a part interest

[21] Appl. No.: 508,072

[22] Filed: Jun. 24, 1983

[51] Int. Cl.[3] ..... B05B 1/34

[52] U.S. Cl. ..... 239/489; 239/DIG. 19

[58] Field of Search ..... 239/486, 487, 494, 495, 239/497, 600, 488, 489, DIG. 1; 277/152, 153, 165; 285/368

[56] References Cited

U.S. PATENT DOCUMENTS

| | | | |
|---|---|---|---|
| 1,311,840 | 7/1919 | Parker | 239/489 |
| 1,778,194 | 10/1930 | Kreager | 239/489 |
| 2,587,140 | 2/1952 | Gorshkoff | 239/489 |
| 3,210,098 | 10/1965 | Watts | 285/368 |
| 3,235,291 | 2/1966 | Jacoby | 285/368 |
| 3,692,243 | 9/1972 | Breunsbach | 239/416 |
| 4,168,033 | 9/1979 | von Bernuth et al. | 239/600 |

FOREIGN PATENT DOCUMENTS

| | | | |
|---|---|---|---|
| 802366 | 10/1958 | United Kingdom | 239/472 |

*Primary Examiner*—Andres Kashnikow
*Assistant Examiner*—Jon M. Rastello
*Attorney, Agent, or Firm*—Glenn K. Robbins

[57] ABSTRACT

A polyurethane spray nozzle for high pressure abrasive aqueous slurries of limestone and the like. The nozzle is comprised of a hollow body of urethane having a restricted inlet and outlet with internal vanes adjacent the inlet to provide a swirling motion to the slurry. The polyurethane construction is characterized by a high degree of abrasion resistance with a slick surface to inhibit solids build up and a degree of flexibility to inhibit clogging of the vanes by solid pieces of limestone. In a modification the body may be made in a first piece while the vanes may be inserted therein in a second integral piece held together by a ring. An outwardly extending flange which may be reinforced with a metallic member is provided for connection to a pipe line source for the slurry. The flange portion connected to the pipe line source may be constructed of a softer polyurethane than the remainder of the spray nozzle to enhance the flange sealing connection.

16 Claims, 9 Drawing Figures

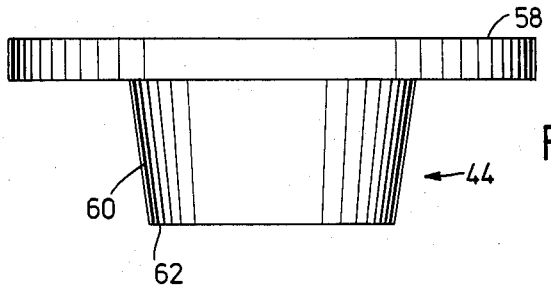
FIG. 5
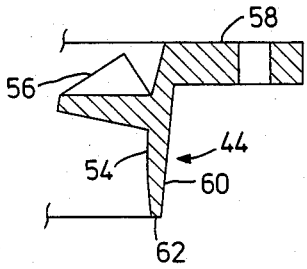
FIG. 6
FIG. 7
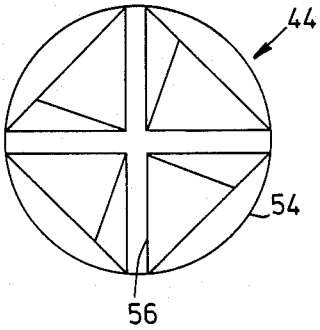
FIG. 8
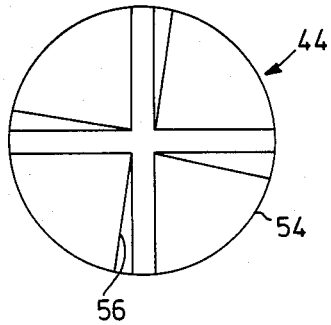
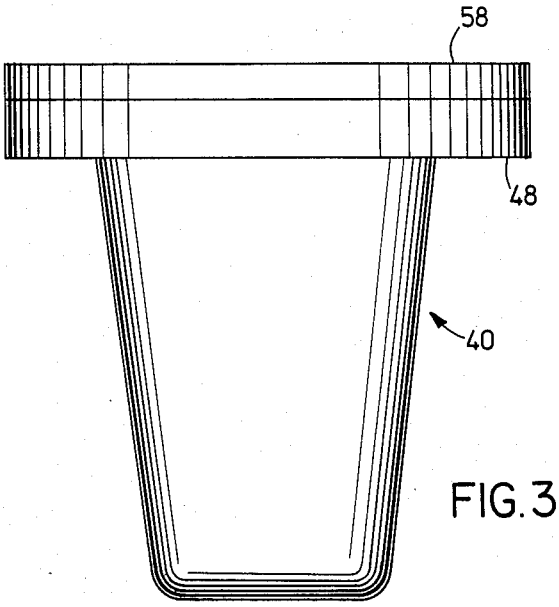
FIG. 3
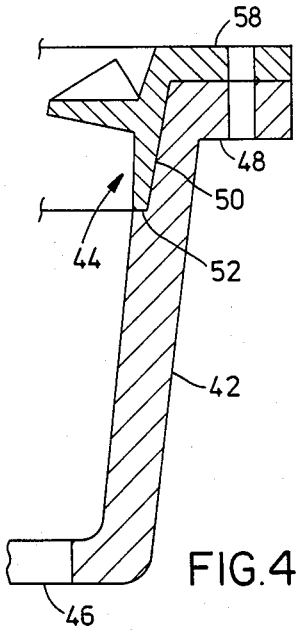
FIG. 4

POLYURETHANE SPRAY NOZZLE FOR ABRASIVE SLURRIES

BACKGROUND OF THE INVENTION

In the past various types of spray nozzles have been employed for high pressure aqueous slurries to provide a spray for one or more purposes. Such a use is typified in spraying limestone slurry in a tower, stack or chamber where it is contacted by combustion gases from the burning of coal. The limestone reacts with sulfurous gases such as sulfur dioxide and the like to form calcium sulfate which is separated from the thus scrubbed gases.

Typical of such spray nozzles is one made of stainless steel with internal vanes to impart a swirling motion to the high pressure slurry to enhance the formation of the spray through which the combustion gas or smoke from the burning of coal is passed. Such nozzles while initially strong and durable are subject over a period of time to pitting and corrosion on the surfaces contacted by the slurry and wear which greatly shortens their life. The rigidity of the vanes further causes problems in occasional clogging of the vanes. All of this contributes to downtime and the attendant expense and reduced efficiency necessitated by repairs and replacement.

Ceramic spray nozzles have likewise been employed in such sustems. While they exhibit improved corrosion and pitting resistance they are relatively fragile and have lessened shock resistance and are subject to breakage. Due to their rigidity they further experience objectionable clogging tendencies to larger sizes of slurry solids. Their increased expense adds to problems in their advantageous employment.

SUMMARY OF THE INVENTION

By means of the instant invention there has been provided an improved spray nozzle of polyurethane which has a good serviceable period of use and has a high degree of abrasion and wear resistance against the slurries with which it is employed. The polyurethane has a slick surface which inhibits the build up of solids from the slurry. A slight degree of flexibility provides for some flexing of the vanes which reduces the tendency to clog from larger particles of limestone or the like employed in the slurry.

The spray nozzle may be formed by casting or molding in one piece of polyurethane. The polyurethane is formed from conventional commercial prepolymers which are reacted with conventional curing agents to form the polyurethane. A hardness of about 90 durometer reading is preferred which provides optimum abrasion and wear resistance coupled with a slick surface and slight flexing of the internal vanes to prevent clogging.

The spray nozzle physical characteristics embody the physical features of proven spray nozzles utilizing a hollow body with a restricted inlet within which the vanes act to impart a swirling motion to the slurry and a restricted outlet which emits the spray to perform the exhaust gas scrubbing action. The strength of the polyurethane coupled with the other advantageous features further permits the use of flanges for connection to a high pressure pipe line source which is employed in the distribution system for the limestone slurry.

In a modification the spray nozzle may be employed in a two piece construction. A bell shaped hollow body having a restricted outlet opening is formed as a first piece while a second piece insert incorporating the internal vane construction and inlet may be molded as the second piece and nested and sealed within the first piece to form the finished spray nozzle device. The flange of the insert which is connected to the pipe line may be formed of a somewhat softer polyurethane to improve the seal against the pipe line source connection. A durometer reading of about 60 for this softer flange portion may be desirably employed.

A reinforcement may also be employed in the flange around flange holes to provide added strength. Such reinforcement may be in the form of metallic washers or a metallic ring provided with registering holes molded in situ around the flange holes.

For improved sealing of the polyurethane flange which because of its softer characteristic than steel or ceramic acts as a gasket and makes a separate gasket unnecessary a nested construction may be employed in the two piece construction. In this modification the exterior softer flange of the insert may be "caged" within a peripheral rim on the exterior of the flange of the body portion. Pressure exerted in connecting the insert flange against the pipe line causes its expansion and tight seal against the body flange and the peripheral rim to effect a water-tight seal against the high pressure employed in the distribution system.

The above features are object of this invention. Further objects will appear in the detailed description which follows and will be further apparent to those skilled in the art.

For the purpose of illustration of this invention preferred embodiments thereof are shown in the accompanying drawing. It is to be understood that the drawing is for purpose of description only and that the invention is not limited thereto.

IN THE DRAWING

FIG. 3 is a view in side elevation of a modified two piece spray nozzle;

FIG. 4 is a fragmentary view in radial vertical section of the right hand portion of the spray nozzle of FIG. 3;

FIG. 5 is a view in elevation of the vane and flange insert used in the spray nozzle of FIG. 3;

FIG. 6 is a fragmentary view in radial vertical section of the right hand portion of the insert;

FIG. 7 is a bottom plan view of the nozzle opening of the spray nozzle of FIG. 3;

FIG. 8 is a top plan view of the nozzle opening of the spray nozzle of FIG. 3.

DESCRIPTION OF THE INVENTION

Figure 1:
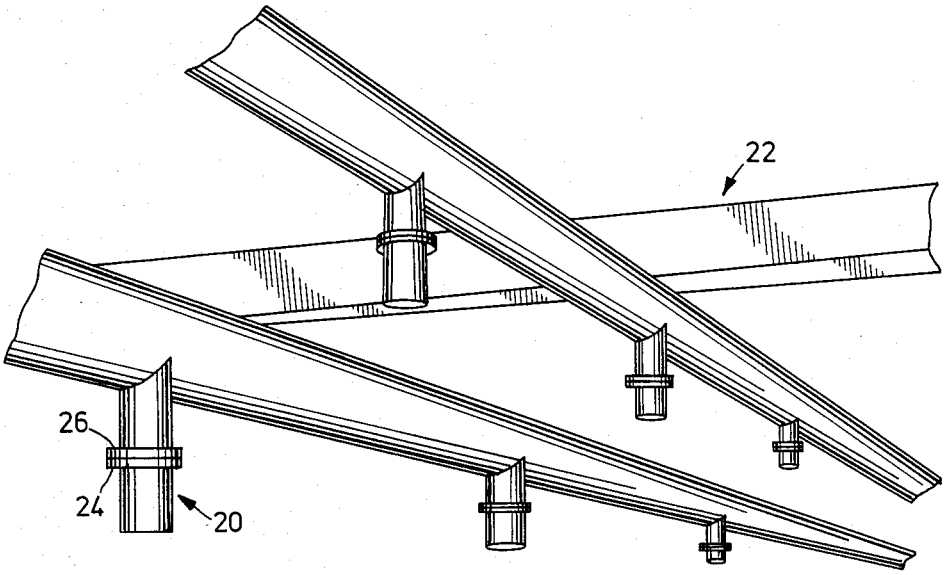
FIG. 1 is a pictorial view showing a bank of spray nozzles connected to a high pressure slurry pipe system.

The spray nozzle of this invention is generally designated by the reference numeral 20 in FIG. 1 where it is shown utilized in a limestone slurry pipe line distribution system 22. The use of a plurality of pipe lines and spray nozzle provides a blanket of limestone slurry spray which the upwardly rising exhaust or smoke stack gases from the combustion contact to effect the scrubbing action and conversion of sulfur gases to precipitated calcium sulfate which is thereby separated from the exhaust gases.

The spray nozzles are connected to the pipe line distribution system by bolts or the like fastening flanges 24 of the spray nozzles to flanges 26 provided in the pipe line distribution system.

Figure 2:
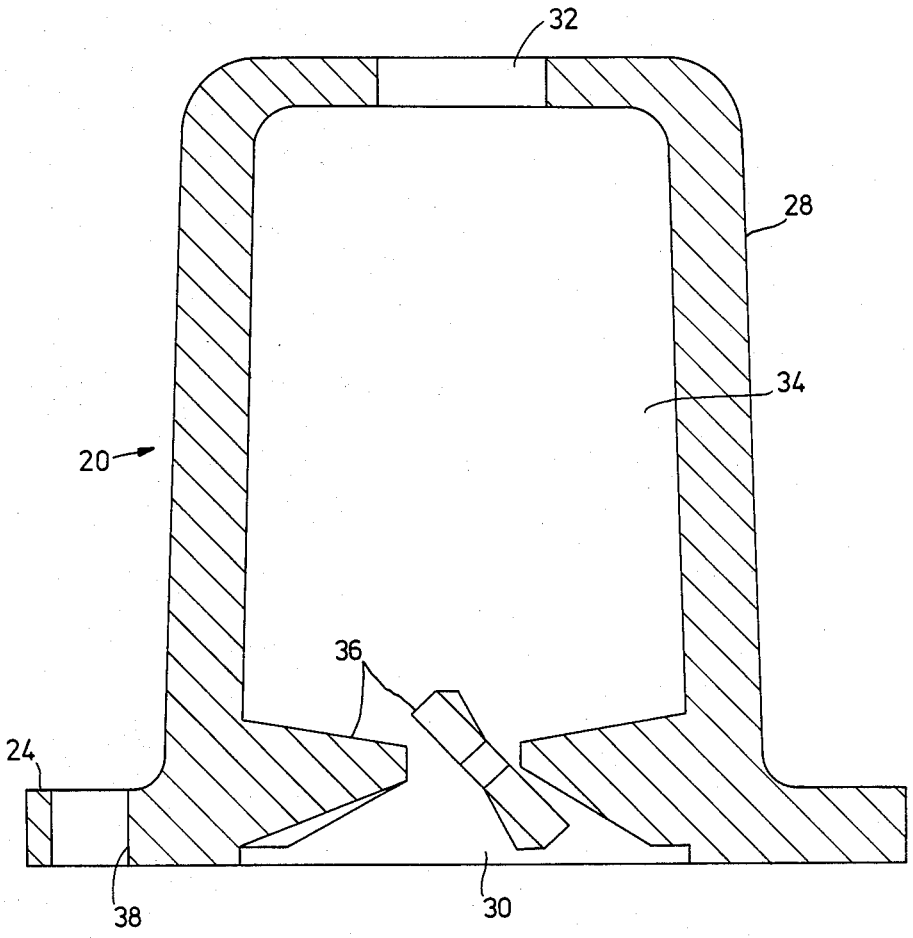
FIG. 2 is a diametrical cross-sectional view of the spray nozzle in inverted position.

The spray nozzle 20 is more particularly shown in FIG. 2. It is comprised of a hollow bell shaped or dome-like body 28 having a restricted inlet 30 and a restricted outlet 32 at opposite ends of an interior mixing reservoir 34. A plurality of radially inwardly extending vanes or blades 36 are positioned adjacent the inlet 30 to provide a swirling motion to the high pressure slurry introduced to the inlet and provide a turbulent mixing in the interior reservoir. The flange 24 extends radially outwardly from the inlet 30 and with the bolt holes 38 forms a means for a water-tight connection to the flanges 26 in the pipe line distribution system.

The entire spray nozzle may be molded, potted or cast in an integral polyurethane construction by the use of conventional commercial isocyanate prepolymers and cured by conventional additives. The polyurethane composition is commercially available and, per se, forms no part of this invention. The polyurethane has a preferred hardness of about 90 durometer reading. The durometer reading is an international standard for hardness measurement of rubber, plastics and other non-metallic materials. This degree of hardness provides a high degree of abrasion and wear resistance and a slick surface which inhibits build up of limestone solids. A slight degree of flexing of the vanes is also provided to reduce any tendency of the internal vanes to clog. Further, the relative softer nature of the polyurethane flanges as contrasted with stainless steel or ceramic spray nozzles permit the flanges to provide a water-tight seal against steel flanges of the pipe line distribution system and eliminate the necessity of separate gaskets.

The polyurethane is obtained conventionally using commercially available isocyanate prepolymers and curing with commercial additives and, per se, forms no part of this invention. Typical of such prepolymers is Uniroyal's B600 Vibrathane and the curative MOCA or 1,4 butanediol which is used to mold the nozzle body and vane sections to provide a durometer reading of about 90. Also typical of such prepolymers is Uniroyals B628 Vibrathane and a blend of curatives such as Andersons Curene 442 and Uniroyals polyal Vibracure A-931 which are employed to obtain a softer polyurethane having a durometer reading of about 60. These are exemplary and not limiting as will be well understood by those skilled in the art.

A two piece modification of the spray nozzle is shown in FIGS. 3 through 8 and is generally indicated by the reference numeral 40. The spray nozzle for greater ease in molding and fabrication is made in two piece as a body piece 42 and a turning vane insert 44.

The body piece 42 has an external configuration generally similar to that of the spray nozzle. A restricted outlet 46 is provided at one end and outwardly extending flange 48 is connected at an opposite end. An inner frusto-conical surface 50 having a shoulder portion 52 receives the vane insert in nested relation as will appear.

The vane insert 44 is molded to have a support ring base 54 from which radial vanes 56 extend inwardly. An outwardly extending flange 58 provided with bolt holes is adapted to register with the flange 48 and bolt holes of the body piece. The support ring 54 has an external frusto-conical surface 60 and shoulder 62 which interfit with the internal surface 50 and shoulder portion 52 of the body piece. The frusto-conical and tapered interfit ensure that the pressure on the insert vane exerted in use as the slurry passes through the spray nozzle tends to drive the body piece and vane insert closer together and separation is inhibited.

Both the body piece and vane insert are molded from isocyanate prepolymers as aforedescribed for the spray nozzle 20 and have a preferred durometer reading of about 90. The two pieces are cemented together by conventional cements which may be for example, a polyurethane.

Figure 9:
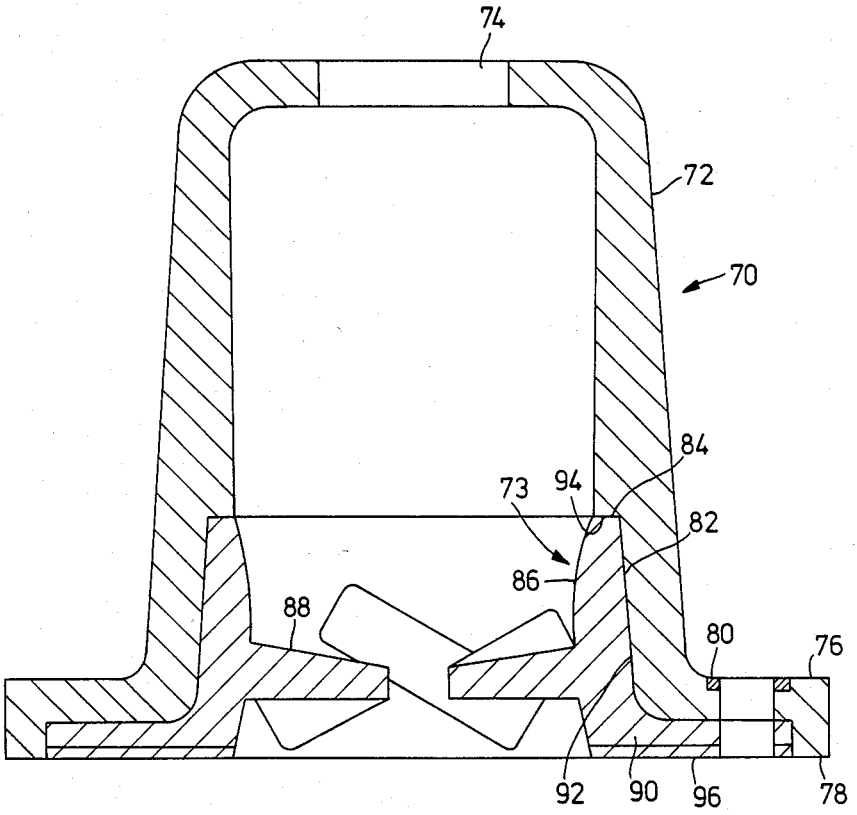
FIG. 9 is a diametrical inverted view in cross-section of a modification of the two piece spray nozzle of FIGS. 3–8 employing a cast-in place flange reinforcing member.

A further two piece modification is shown in FIG. 9 and is generally designated by the reference numeral 70. The spray nozzle is generally similar to the two piece spray nozzle 40 described in FIGS. 3 through 8 but features a softer polyurethane portion of the vane insert and improved sealing and reinforcing functions for the flange as will appear hereinbelow.

The two piece spray nozzle 70 is comprised of a body 72 and a vane insert piece 73. The body piece is provided with a restricted outlet opening 74 at one end and outwardly extending flange 76 at an opposite end. The flange has a vertical rim-like border 78 which closely receives a mating flange of the vane insert. Metallic washer-like reinforcing members 80 are molded in situ to provide additional strength to the flange when bolted to connecting flanges of the pipe line slurry distribution system. An inner frusto-conical surface 82 having a shoulder portion 84 receives the vane insert in snug relation as in the two piece spray nozzle 40 as aforementioned.

The vane insert 73 is molded similarly to the vane insert 44 and has a support ring 86 from which radial vanes 88 extend inwardly. An outwardly extending flange 90 having bolt holes is adapted to register the flange 76 and bolt holes of the body piece. The flange 90 is of a lesser diameter than the flange 76 and is dimensioned to fit snugly inside the border rim 78 so as to be caged therein.

As in the two piece spray nozzle the vane insert is provided with an exterior frusto-conical surface 92 on the support ring and a shoulder 94 which interfit snugly with the internal surface 82 and shoulder portion 84 of the body piece.

In order to provide an increased flange sealing function the flange 90 has an outer portion 96 which is softer. The pressure exerted in connecting the spray nozzle to the connecting flange of the pipe line distribution system when connecting bolts or the like tighten the respective flanges together cause the external flange portion 96 to expand against the rim 78 of the body flange and improve the flange seal.

The flange portion 96 is desirably of a durometer reading of about 60. The remaining portion of the vane insert 73 including the flange 90 and the body piece are molded to provide a polyurethane having a hardness of a durometer reading of about 90.

While the insert vane has been described above as having a durometer reading of about 90 except for the softer flange portion, the entire insert vane may be of a lower durometer reading to provide increased flexibility to the vanes to inhibit cloggin by solids or only the vanes. Thus, the polyurethane construction may be varied as desired.

USE

The polyurethane spray nozzle of this invention is employed in a like manner to the stainless steel and ceramic spray nozzle of conventional construction. The spray nozzle whether it be the one piece nozzle 20, or the two piece embodiments 40 or 70 is simply employed by connecting the flanges to flanges of the pipe line distribution system. Due to the polyurethane relative softness as compared to steel or ceramic the connection may be made without the required use of a separate gasket. Where an especially tight seal is required for some extremely high pressure slurry systems the spray nozzle 70 may be employed with the softer polyurethane flange.

The spray nozzle when connected to the pipe line distribution system for a slurry such as limestone conventionally employing, as an example 12% limestone, may be used to provide a blanket of spray for sulfur containing coal combustion gases in a scrubbing system. In such systems it has been found that the life of the spray nozzle may be substantially extended over that of stainless steel nozzles. The wear and abrasion resistance of the polyurethane construction coupled with the slick surface provided by the polyurethane resist the build up of solids and inhibit corrosion and pitting. The slight flexibility of the vanes further increases efficiency by lessening the tendency to clog. These advantages along with substantially less cost than stainless steel or ceramic provide for significant efficiencies in use.

Various changes and modifications may be made within this invention as will be apparent to those skilled in the art. Such changes and modifications are within the scope and teaching of this invention as defined in the claims appended hereto.

What is claimed is:

1. A polyurethane spray nozzle for high pressure abrasive aqueous slurries of limestone and the like, said nozzle comprising a hollow integral body of polyurethane, said body having a restricted inlet opening, an expanded interior hollow reservoir and a restricted outlet opening, said inlet opening being defined by a plurality of polyurethane radial vanes to impart a swirling motion to a high pressure slurry introduced from a slurry pipe source, said polyurethane being characterized by a durometer reading of about 90, a high degree of abrasion resistance and slick surface to inhibit solids build up and wear on surfaces of the nozzle contacted by said slurry and resistance to corrosion by limestone and said vanes having a flex characteristic to inhibit clogging by discrete particles of limestone or the like comprising said slurry and an outwardly extending flange having at least a laterally extending portion of the flange integrally connected to said body adjacent said inlet opening and said flange being adapted to be rigidly connected to a mating flange in said pipe line source.

2. The spray nozzle of claim 1 in which at least a portion of the flange adapted to mate against said mating flange in said pipe line source is softer than said body and vanes to provide an improved sealing relation against the mating flange in said pipe line source.

3. The spray nozzle of claim 2 in which said softer portion of and at least a portion of the flange has a durometer reading of about 60.

4. The spray nozzle of claim 1 in which the flange is provided with a plurality of holes adapted to receive bolts or the like for connection to said mating flange in the pipe line source.

5. The spray nozzle of claim 4 in which a metallic reinforcing member is molded in situ in said flange, said reinforcing member having openings registering with the aforementioning holes in said flange to provide reinforced strength.

6. The spray nozzle of claim 1 in which said first mentioned flange has an interior portion contacting said mating flange which is softer than said body and vanes to provide an improved sealing relation against the mating flange in said pipe line source.

7. The spray nozzle of claim 1 in which said body and at least a portion of the flange are molded in one piece and said vanes are molded in a second piece, said second piece being insertable within said first piece and being sealed thereto.

8. The spray nozzle of claim 7 in which said second piece is comprised of a ring member and said vanes are connected integrally to said ring and extend inwardly, said ring member being nestable within a mating portion of said first piece and sealed thereto.

9. The spray nozzle of claim 8 in which said second piece has an integral outwardly extending flange portion adjacent said inlet opening adapted to be rigidly connected to a mating flange in said pipe line source.

10. The spray nozzle of claim 7 in which said first mentioned flange has an interior portion contacting said mating flange which is softer that said body and vanes to provide an improved sealing relation against the mating flange in said pipe line source.

11. The spray nozzle of claim 1 in which a metallic reinforcing member is molded in situ in said first mentioned flange, said reinforcing member having openings registering with openings in said flange to provide reinforced strength.

12. The spray nozzle of claim 7 in which both said first and second pieces have outwardly extending flanges which mate against one another and the flange of the insertable second piece is softer than the first piece and the vanes of the second piece.

13. The spray nozzle of claim 12 in which at least a portion of the flange of the second piece is engageable with the mating flange of the pipe line and has a durometer reading of about 60.

14. The spray nozzle of claim 12 in which a metallic reinforcing member is molded in situ in the flange of the first piece, said reinforcing member having openings registering with holes in said flange to provide reinforced strength.

15. The spray nozzle of claim 12 in which the flange of the first piece has a peripheral rim and receives the flange of the second piece in closely nested relation.

16. The spray nozzle of claim 15 in which at least a portion of the flange of the second piece has a durometer reading of about 60 and a metallic reinforcing member is molded in situ in the flange of the first piece, said reinforcing member having openings registering with holes in said flange to provide reinforcing strength.

* * * * *